US010960418B2

(12) United States Patent
Dixon

(10) Patent No.: US 10,960,418 B2
(45) Date of Patent: Mar. 30, 2021

(54) CROSS BAR FOR POWDER COATING AND ELECTRONIC COATING

(71) Applicant: Production Plus Corp., Ashville, OH (US)

(72) Inventor: Donovan Dixon, South Bloomfield, OH (US)

(73) Assignee: PRODUCTION PLUS CORP., Ashville, OH (US)

( * ) Notice: Subject to any disclaimer, the term of this patent is extended or adjusted under 35 U.S.C. 154(b) by 0 days.

(21) Appl. No.: 16/734,003

(22) Filed: Jan. 3, 2020

(65) Prior Publication Data

US 2020/0215558 A1 Jul. 9, 2020

Related U.S. Application Data

(60) Provisional application No. 62/787,882, filed on Jan. 3, 2019.

(51) Int. Cl.

| | |
|---|---|
| ***B05B 5/025*** | (2006.01) |
| ***B21D 53/00*** | (2006.01) |
| ***B05B 5/08*** | (2006.01) |

(52) U.S. Cl.

CPC ..... *B05B 5/025* (2013.01); *B05B 5/082* (2013.01); *B21D 53/00* (2013.01)

(58) Field of Classification Search

CPC ..... B05B 5/025; B05B 5/082; B21D 53/00; A47B 43/003; A47B 43/006; C25D 17/06; C25D 17/08; B05C 13/02

USPC ..... 211/105.1, 117, 119, 118, 124; 118/500, 118/501, 503; 204/297.01, 297.06

See application file for complete search history.

(56) References Cited

U.S. PATENT DOCUMENTS

| | | | | | |
|---|---|---|---|---|---|
| 258,214 | A | * | 5/1882 | Brinckmann | C25D 17/06 204/297.12 |
| 811,375 | A | * | 1/1906 | Clark | C25D 17/08 204/297.06 |
| 1,095,006 | A | | 4/1914 | Lowe | |
| 1,184,246 | A | | 5/1916 | Klein | |
| 1,590,698 | A | | 6/1926 | Ray | |
| 1,661,303 | A | * | 3/1928 | Price | B23K 9/32 219/138 |
| 2,137,819 | A | * | 11/1938 | Wagner | C25D 17/08 204/297.07 |
| 2,196,663 | A | * | 4/1940 | Isele | C25D 17/08 118/500 |
| 2,346,386 | A | * | 4/1944 | Nankervis | C25D 17/08 204/297.1 |
| 2,462,431 | A | * | 2/1949 | Schneider | C25D 17/08 211/113 |
| 2,505,212 | A | | 4/1950 | Schneider | |
| 2,514,923 | A | | 7/1950 | Batina | |
| 2,533,464 | A | | 12/1950 | Jasper | |
| 2,557,231 | A | | 6/1951 | Miller | |
| 2,652,359 | A | | 9/1953 | Schneider | |

(Continued)

*Primary Examiner* — Jennifer E. Novosad

(74) *Attorney, Agent, or Firm* — Standley Law Group LLP; Melissa Rogers; Adam Smith

(57) ABSTRACT

A cross bar for powder coating and electronic coating, and methods for forming the same. A connector extends between a front portion and a rear portion. Embosses are located in the front and rear portions to connect with each other. Drain holes are provided at spaced intervals along the front and rear portions, offset from one another.

19 Claims, 6 Drawing Sheets

(56) References Cited

U.S. PATENT DOCUMENTS 2,858,265 A * 10/1958 Schneider ..... C25D 17/08 204/297.09
2,858,266 A * 10/1958 Schneider ..... C25D 17/08 204/297.09
2,911,347 A * 11/1959 Gutzmer ..... C25D 17/08 204/297.02
2,954,222 A * 9/1960 Evans ..... C21D 9/0025 266/274
3,029,952 A * 4/1962 Bagdon ..... B65G 17/20 211/117
3,095,665 A 7/1963 Killen
3,118,545 A 1/1964 Rosner
3,272,733 A * 9/1966 Linquist ..... C25D 17/08 204/297.1
3,279,428 A * 10/1966 Schad ..... B05C 3/09 118/501
3,290,238 A * 12/1966 Wierwille ..... C25D 17/08 204/297.1
3,357,913 A * 12/1967 Zavarella ..... C25D 17/08 204/297.06
3,484,361 A 12/1969 Sperry
3,696,939 A * 10/1972 Drowatzky ..... A22C 15/007 211/117
3,715,097 A 2/1973 Kalajian
3,799,488 A 3/1974 Sena
3,901,788 A 8/1975 Schaer
D238,029 S 12/1975 Howard et al.
3,923,631 A * 12/1975 Palisin, Jr. ..... C25D 17/08 204/297.06
3,972,785 A * 8/1976 Palisin, Jr. ..... C25D 17/08 204/297.1
4,037,727 A * 7/1977 Kunkle ..... A47F 5/10 211/117
4,097,359 A * 6/1978 Davitz ..... B05B 5/082 118/500
4,129,217 A 12/1978 Campbell
4,134,614 A 1/1979 Fielding, Sr.
4,217,853 A * 8/1980 Davitz ..... B05B 5/082 118/500
4,243,146 A * 1/1981 Davitz ..... B05C 13/00 118/500
4,424,908 A * 1/1984 Davitz ..... B05C 13/00 108/149
4,447,049 A * 5/1984 Rudy ..... B25B 5/14 211/117
4,558,522 A 12/1985 Lance
4,628,859 A * 12/1986 Hines ..... B05B 5/082 118/500
4,862,963 A 10/1989 Van Horn
4,872,963 A * 10/1989 Van Horn ..... C25D 13/22 204/297.09
4,880,194 A 11/1989 Geise et al.
5,020,677 A * 6/1991 Wirth ..... A47F 5/08 118/500
5,078,928 A * 1/1992 Balster ..... A45D 24/00 118/501
5,084,155 A * 1/1992 Engwall ..... C25D 17/08 204/297.1
5,088,609 A * 2/1992 Fryc ..... C25D 17/08 118/503
5,147,050 A * 9/1992 Cullen ..... B05B 5/082 118/500
5,279,428 A 1/1994 Lee
5,296,030 A 3/1994 Young
5,365,813 A 11/1994 Greene
5,524,774 A * 6/1996 Cullen ..... B05B 5/082 118/500
5,531,334 A * 7/1996 Forby ..... B05B 13/02 118/500
5,536,377 A * 7/1996 Hiermaier ..... C25D 17/06 204/199
5,607,069 A 3/1997 Stroobants et al.
5,762,205 A * 6/1998 Davitz ..... B05B 5/082 211/117
5,790,454 A 8/1998 Choi
5,897,709 A * 4/1999 Torefors ..... B05B 5/082 118/500
D409,858 S 5/1999 Reed
5,906,282 A 5/1999 Aldrich et al.
5,908,120 A 6/1999 Yates et al.
5,924,577 A 7/1999 Gessert
D418,693 S 1/2000 Kopala, Jr.
D419,335 S 1/2000 Kopala, Jr.
D424,320 S 5/2000 Klein et al.
6,189,709 B1 * 2/2001 Cullen ..... B05B 5/082 211/118
6,530,489 B1 * 3/2003 Van Horn ..... B05B 13/0264 211/113
6,550,623 B2 4/2003 Cook et al.
6,571,968 B1 * 6/2003 Cullen ..... B05B 5/082 118/500
6,588,605 B1 7/2003 Volkert et al.
D486,008 S 2/2004 Pospisil et al.
6,702,130 B1 3/2004 Carlisle
7,021,476 B2 4/2006 Lloyd et al.
7,322,310 B2 * 1/2008 McKay ..... A23G 9/288 118/13
D566,405 S 4/2008 Belokin
D591,085 S 4/2009 Burns
7,748,544 B1 * 7/2010 Davitz ..... B25H 3/04 211/70.6
D623,015 S 9/2010 D'Amato et al.
D625,055 S 10/2010 Oliver
D625,120 S 10/2010 Wisniewski
7,878,338 B2 2/2011 Maxson
8,066,267 B2 11/2011 Schaerer
D661,526 S 6/2012 Evans
8,215,502 B1 * 7/2012 Beavers ..... C25D 17/08 211/119
8,221,601 B2 * 7/2012 Chen ..... C25D 17/004 204/297.06
D680,773 S 4/2013 Tebbe et al.
8,646,625 B2 * 2/2014 Wang ..... A47G 25/06 211/106.01
8,956,514 B2 2/2015 Hocevar et al.
D727,631 S 4/2015 Irvin
D734,951 S 7/2015 Levin et al.
D735,412 S 7/2015 Coleman
D737,077 S 8/2015 Cockayne et al.
D745,794 S 12/2015 Knoll et al.
D785,381 S 5/2017 Johnson
D785,383 S 5/2017 Johnson
9,926,704 B1 * 3/2018 Nowacek ..... E04D 1/34
9,943,891 B2 4/2018 Dixon
D818,724 S 5/2018 Davison et al.
D833,781 S 11/2018 Hartman et al.
10,137,726 B2 11/2018 Murrow
D839,481 S 1/2019 Seutter
D853,158 S 7/2019 Nichols et al.
D860,677 S 9/2019 Chesterton
D865,475 S 11/2019 Cross
D878,831 S 3/2020 Rortvedt et al.
2002/0112954 A1 * 8/2002 Evans ..... C25D 17/08 204/297.1
2003/0141267 A1 7/2003 Lloyd et al.
2003/0209504 A1 11/2003 Cook et al.
2004/0206713 A1 10/2004 Lloyd et al.
2004/0238465 A1 12/2004 Mercure
2006/0196838 A1 9/2006 Mercure et al.
2007/0039632 A1 2/2007 Dean et al.
2010/0300997 A1 * 12/2010 Bramley ..... A47L 15/505 211/74
2012/0273439 A1 11/2012 Beavers et al.
2013/0075252 A1 * 3/2013 Wright ..... C25D 17/08 204/297.1
2013/0228460 A1 * 9/2013 Tsai ..... C25D 17/08 204/297.06
2017/0120313 A1 5/2017 Dixon

(56) References Cited

U.S. PATENT DOCUMENTS

| | | | | |
|---|---|---|---|---|
| 2018/0257120 | A1 | 9/2018 | Dixon | |
| 2020/0215558 | A1* | 7/2020 | Dixon | B21D 22/04 |

* cited by examiner

CROSS BAR FOR POWDER COATING AND ELECTRONIC COATING

CROSS-REFERENCE TO RELATED APPLICATION

This application claims the benefit of U.S. Provisional Application Ser. No. 62/787,882 filed Jan. 3, 2019, the disclosures of which are hereby incorporated by reference as if fully restated herein.

TECHNICAL FIELD

Exemplary embodiments of the present invention relate generally to cross bars for powder coating and electronic coating (hereinafter also "e-coating").

BACKGROUND AND SUMMARY OF THE INVENTION

Two coating processes that can be used to apply paint or another substance to a metal part are powder coating and e-coating. Powder coating involves generating an electrically charged cloud of plastic particulate (powder). A cross bar is provided from which one or more parts to be coated are hung. An opposite electrical charge is provided to and passed through the cross bar and the part(s) hung therefrom. The cross bar and associated parts are passed through the powder, and due to the opposite electrical forces, the powder adheres to the part(s). The part(s) are then typically delivered to an oven where they undergo a baking process to solidify the powder coat. Because the cross bar and its hangers are also electrically charged, powder may also adhere to the cross bar and the hangers.

E-coating is a process where liquid is used, instead of a powder, to coat the metal part(s). A tank or other vat of electrically charged liquid is provided. A cross bar is also provided from which one or more parts to be coated are hung. An opposite electrical charge is provided to and passed through the cross bar and the part(s) hung therefrom. The cross bar and associated parts are passed through the liquid, typically by dipping the part(s) into the tank or vat. Due to the opposite electrical forces, the liquid adheres to the part(s). The part(s) are then typically delivered to an oven where they undergo a baking process to solidify the coating. The results of e-coating or powder coating are generally better than the alternative approach of wet spraying. In order to ensure complete coverage, the hangers and the cross bar are often dipped with the parts. Because the cross bar and its hangers are also electrically charged, liquid may also adhere to the cross bar and the hangers. In order to avoid transfer onto new parts, and to avoid excess liquid build up, the cross bar and the hangers generally need cleaning before they can be reused for a new set of parts.

Regardless of which process is used, in order to avoid transfer onto new parts and to avoid excess build up which may prevent an effective electrical connection, the cross bar and the hangers generally need cleaning before they can be reused for a new set of parts. In many cases, the excess coating may be removed by exposing the cross bar and hangers to very high temperatures, rinsing the cross bar and hangers in fresh water, solvents, or some other liquids, or some combination thereof.

There is a need in the art for a cross bar that can be used for both powder coating and e-coating and which possesses certain features which makes the cross bar well-suited for both processes. Doing so would reduce manufacturing complexity, design complexity, provide versatility in use, reduce the number of parts needed in space inventory, and the like. For example, without limitation, because the cross bar is passed through liquid during e-coating, typical powder coating cross bars do not provide adequate drainage for effective use. During e-coating, drainage is required to permit excess liquid to exit the cross bar as well as permit adequate cleaning for reuse. Yet, traditional e-coating bars are not well suited for powered coating. Traditional e-coating bars are very, or completely, open, which if used in a powder coating application would cause the powder paint to build up inside the bar. This paint would interrupt the electrical supply between the bar and the hanger, preventing effective coating.

Therefore, what is needed is a cross bar which can be used for both powder coating and e-coating. The present invention is a cross bar which can be used for both powder coating and e-coating.

The cross bar may comprise a number of drain holes. The drain holes may be configured to permit the draining of liquid used in e-coating and provide effective rinsing when cleaning. In exemplary embodiments, a first set of drain holes is located along an upper edge of the cross bar while a second set of drain holes is located along the front and rear surfaces of the cross bar. Embosses may be spaced along the cross bar. The embosses may be configured to accommodate hangers, from which parts to be coated may be hung, between adjacent embosses. A third set of drain holes may be located along a lower edge of the cross bar. The cross bar may be formed by punching, cutting, or otherwise forming the drain holes and embosses in a piece of sheet metal and folding the piece of sheet metal in half.

Further features and advantages of the devices and systems disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, unless particular shapes are specifically claimed, embodiments of the invention should not be construed as limited to the particular shapes of regions illustrated herein but are to include deviations in shapes that result, for example, from manufacturing.

Figure 1:
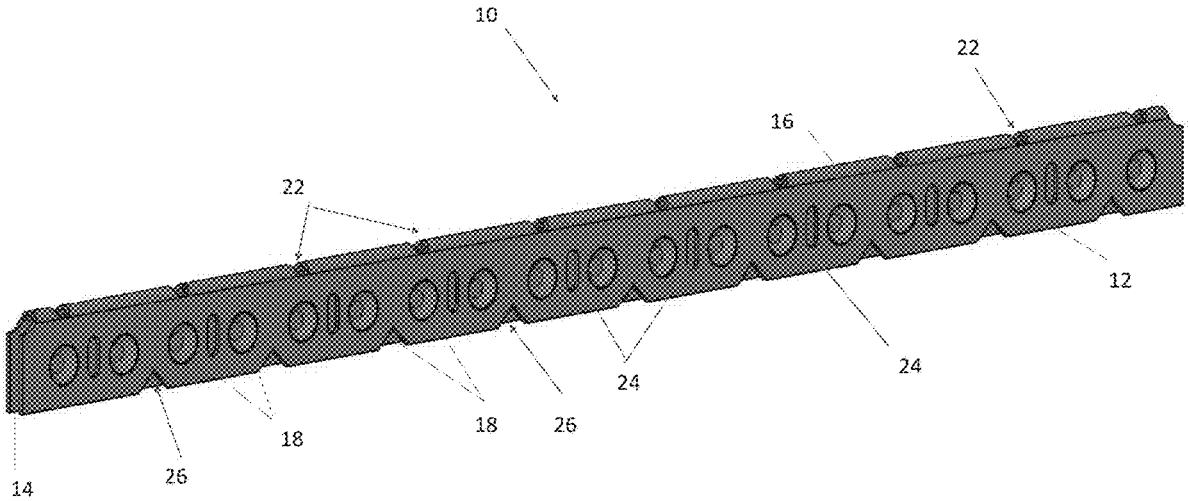
FIG. 1 is a front perspective view of an exemplary cross bar.

FIG. 1 illustrates an exemplary cross bar 10 in accordance with the present invention. The cross bar 10 may comprise a front portion 12 and a rear portion 14. The front portion 12 may be positioned in front of the rear portion 14. The front portion 12 may be spaced apart from and extend substantially parallel with the rear portion 14. The front portion 12 may have a surface area equal to the surface area of the rear portion 14, though such is not required. In other exemplary embodiments, the front portion 12 and the rear portion 14 may be have different surface areas. The front portion 12 and/or the rear portion 14 may be rectangular in shape. The front portion 12 may have the same or similar shape to the rear portion 14, though such is not required. In other exemplary embodiments, the front and rear portions 12 and 14 may be have different shapes.

A connector 16 may extend between and connect the front and rear portions 12 and 14. In some embodiments, the connector 16 may extend between an upper edge of the front portion 12 and an upper edge of the rear portion 14. In exemplary embodiments, the front portion 12 and the rear portion 14 may be formed from a single piece of sheet metal, which may be bent over itself. In such embodiments, the upper portion of the bent piece of sheet metal may form the connector 16. The connector 16 may form a U-shape, though any shape may be utilized.

A number of embosses 18 may be formed in the front portion 12 of the cross bar 10. Alternatively, or additionally, a number of embosses 18 may be formed in the rear portion 14 of the cross bar 10. The embosses 18 may be formed by stamping, though other techniques may be utilized. The embosses 18 may form a cone-shape, such as but not limited to a truncated cone, that extends into the space between the front portion 12 and the rear portion 14. Other shapes for the embosses 18 may be utilized. The embosses 18 may be of the same or of varying shape. Embosses 18 provided on the front portion 12 may be positioned to contact embosses 18 provided on the rear portion 14. The embosses 18 may be joined to one another by welding, bonding, adhesion, some combination thereof, or the like. In exemplary embodiments, the portions of the embosses 18 extending from the front portion 12 and the rear portion 14 may be joined to one another by spot welding, though other techniques may be utilized. In other exemplary embodiments, some or all of the embosses 18 on the front portion 12 may be staggered relative to the embosses 18 on the rear portion 14. In such embodiments, the respective embosses 18 may be welded or otherwise joined to the opposing one of the front portion 12 or the rear portion 14.

Figure 10:
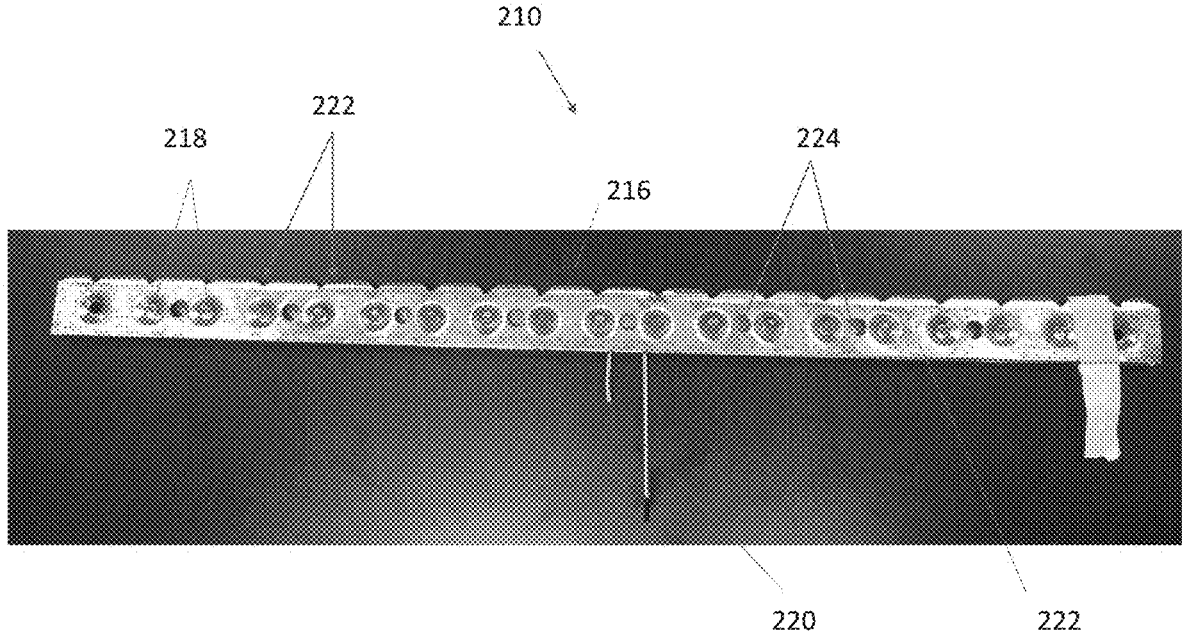
FIG. 10 is a front view of another exemplary cross bar with an exemplary hanger installed.

The spacing of the embosses 18 may be configured to accommodate at least one a hanger, such as but not limited to hanger 220 illustrated and described with respect to FIG. 10, between adjacent embosses 18. For example, without limitation, a hanger may be wedged between adjacent embosses 18, extend over one of the embosses 18, or otherwise frictionally engage said embosses 18. The embosses 18 may be spaced apart to accommodate such hangers.

A first set of drain holes 22 may be spaced apart along the connector 16. In some exemplary embodiments, the first set of drain holes 22 are substantially oval or circular in shape. However, other size and shape holes in the first set of drain holes 22 may be utilized. The first set of drain holes 22 may be formed by stamping, cutting, or otherwise forming notches in the connector 16. In other exemplary embodiments, the first set of drain holes 22 may be cut, punched, or otherwise formed in the flattened sheet metal into the desired shape(s). Such forming may, in exemplary embodiments, be performed prior to folding the sheet metal to form the cross bar 10. Each of the holes in the first set of drain holes 22 may be the same or different in size and shape. In exemplary embodiments, one of the first set of drain holes 22 may be located substantially above every-other emboss 18, though any number and location of the first set of drain holes 22 may be utilized. Such drain holes 22 may be configured to drain water or cleaning fluids. Such drain holes 22 may alternatively or additionally be configured to drain excess paint or other coating fluids.

A second set of drain holes 24 may be provided on the front portion 12. The second set of drain holes 24 may alternatively or additionally be provided on the rear portion 14. The second set of drain holes 24 may be substantially oval in shape and oriented such that the longer portion of the oval extends vertically, though any size, shape, or orientation may be utilized. The second set of drain holes 24 may be formed by cutting, stamping, or otherwise forming ovals in the front and/or rear portions 12 and 14. In other exemplary embodiments, the second set of drain holes 24 may be cut, punched, or otherwise formed in flattened sheet metal. Such forming may be accomplished prior to folding the sheet metal to form the cross bar 10. Each of the holes in the second set of drain holes 24 may be provided between adjacent embosses 18. In exemplary embodiments, one of the second set of drain holes 24 may be located between every two embosses 18, though any number and location of the second set of drain holes 24 may be utilized. In exemplary embodiments, each of the holes in the second set of drain holes 24 are the same sizes, shape, and orientation though such is not required. Each of the holes in the second set of drain holes 24 may be of varying size, shape, and/or orientation.

In exemplary embodiments, the second set of drain holes 24 provided on the front portion 12 may be staggered relative to the second set of drain holes 24 provided on the rear portion 14. In this way, rinsing water or other fluid may be sprayed into the second set of drain holes 24 on the front portion 12 and may contact the rear portion 14, causing the water to be dispersed through the cross bar 10. Alternatively or additionally, rinsing water or other fluid may be sprayed into the second set of drain holes 24 on the rear portion 14 and may contact the front portion 12, causing the water to be dispersed through the cross bar 10. The drain holes 24 may be configured to drain water or cleaning fluids. Such drain holes 24 may alternatively or additionally be configured to drain excess paint or other coating fluids.

A third set of drain holes 26 may be provided on the front portion 12. The third set of drain holes 26 may alternatively or in addition be provided on the rear portion 14. The third set of drain holes 26 may alternatively be referred to herein as notches 26. In some exemplary embodiments, each of the holes in the third set of drain holes 26 may be substantially triangular in shape, though any size or shape may be utilized by other embodiments. The third set of drain holes 26 may be formed by cutting, punching, or otherwise forming triangular-shaped notches along the bottom edge of the front and/or rear portions 12 and 14. Some or all of the third set of drain holes 26 may extend to the lower edge of the front and/or rear portions 12 and 14.

In exemplary embodiments, the third set of drain holes 26 may be cut, punched, or otherwise formed in the flattened sheet metal. Such forming may be performed prior to folding the sheet metal to form the cross bar 10. Each of the holes in the third set of drain holes 26 may be the same or different in size and shape. Each of the holes in the third set of drain holes 26 may be provided between adjacent embosses 18. In exemplary embodiments, one of the third set of drain holes 26 may be located between every two embosses 18, though any number and location of the second set of drain holes 24 may be utilized. The first, second, and/or third set of drain holes 22, 24, and 26 may be configured to permit the draining of liquid used in e-coating.

In exemplary embodiments, the third set of drain holes 26 provided on the front portion 12 are staggered from the third set of drain holes 26 provided on the rear portion 14. In this way, rinsing water or other fluids may be sprayed into the third set of drain holes 26 on the front portion 12 and may contact the rear portion 14, causing the rinsing water or other fluids to be dispersed through the cross bar 10 to improve rinsing. Alternatively, or additionally, rinsing water or other fluids may be sprayed into the third set of drain holes 26 on the rear portion 14 and may contact the front portion 12, causing the rinsing water or other fluids to be dispersed through the cross bar 10 to improve rinsing. Such drain holes 26 may be configured to drain water or cleaning fluids. Such drain holes 26 may alternatively or additionally be configured to drain excess paint or other coating fluids.

In some exemplary embodiments, the second set of drain holes 24 may be staggered as compared to the first set of drain holes 22 and/or the third set of drain holes 26. In this way, rinsing water or other fluids sprayed into one of the first, second or third set of drain holes 22, 24, or 26 may be forced to travel a sinuous path through the cross bar 10 before exiting the same or another of the first, second or third set of drain holes 22, 24, or 26, thus causing the rinsing water or other fluids to be dispersed through the cross bar 10 to improve rising and other cleaning.

An exemplary embodiment of the cross bar 10 is described herein. The front portion 12 comprises a series of embosses 18 spaced apart from one another along the length of the cross bar 10. The rear portion 14 likewise comprises a series of embosses 18 spaced apart from one another along the length of the cross bar 10. The embosses 18 provided on the front portion 12 are aligned with the embosses 18 on the rear portion 14 such that the embosses 18 contact one another.

The connector 16 extends between an upper edge of the front portion 12 and an upper edge of the rear portion 14. The first set of drain holes 22 comprise a series of circular shaped openings that are spaced apart along the connector 16. The second set of drain holes 24 comprise a series of vertically oriented, oval shaped openings that are spaced apart along the front portion 12 and along the rear portion 14. The second set of drain holes 24 are spaced apart such that two embosses 18 are located between each of the holes in the second set drain of holes 24. Additionally, the second set of drain holes 24 located along the front portion 12 are staggered from the second set of drain holes 24 located along the rear portion 14 such that water or other fluids entering the cross bar 10 through the second set of drain holes 24 is configured to contact the opposite side 12 or 14 and be dispersed through the cross bar 10 to promote thorough coverage.

The third set of drain holes 26 comprise a series of triangular shaped notches 26 spaced apart along a lower edge of the cross bar 10. The third set of drain holes 26 are spaced apart such that they are located between every second and third emboss 18 on a respective side 12 or 14 of the cross bar 10. The third set of drain holes 26 on the front portion 12 are staggered from the third set of drain holes 26 on the rear portion 14.

The cross bar 10 is formed by punching, cutting, or otherwise forming the first set of drain holes 22, the second set of drain holes 24, and the third set of drain holes 26 into a piece of sheet metal, forming the embosses 18, and folding the sheet metal in half to form the front portion 12, the rear portion 14, and the connector 16. The embosses 18 may be welded to one another.

Figure 2:
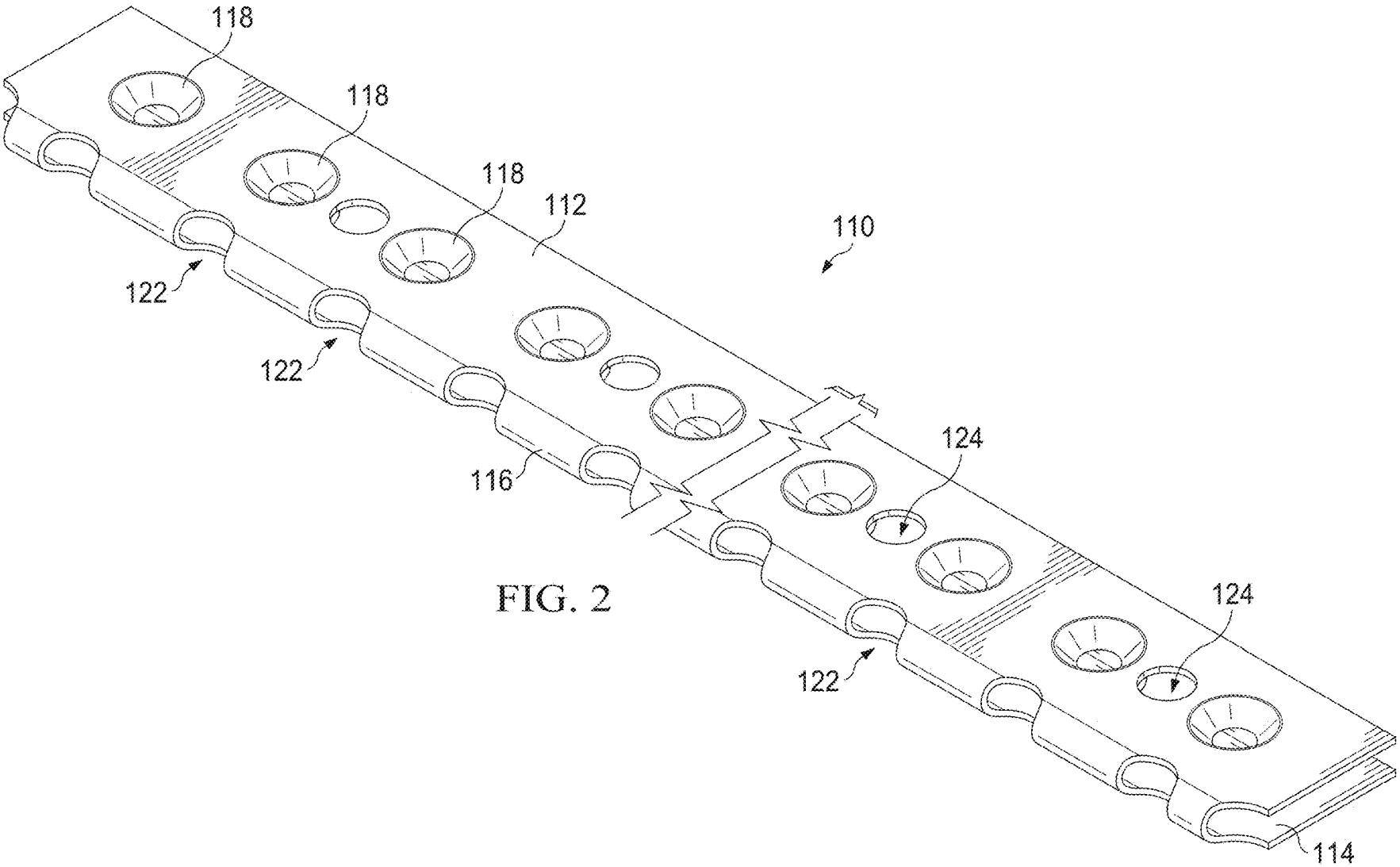
FIG. 2 is a front perspective view of another exemplary cross bar.
Figure 3:
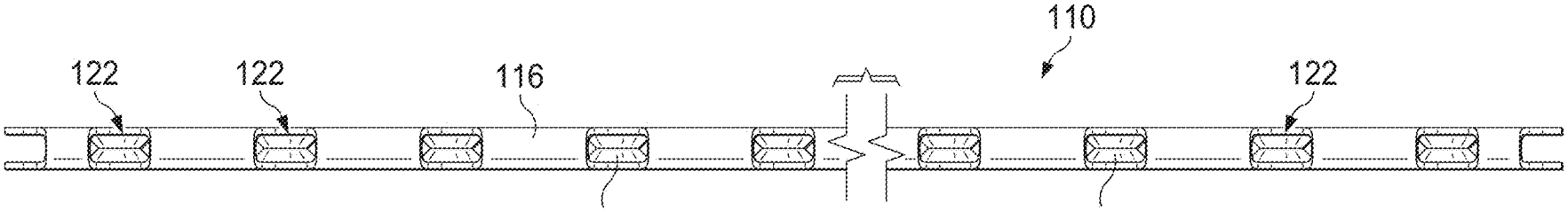
FIG. 3 is a front elevation view of the cross bar of FIG. 2.
Figure 4:
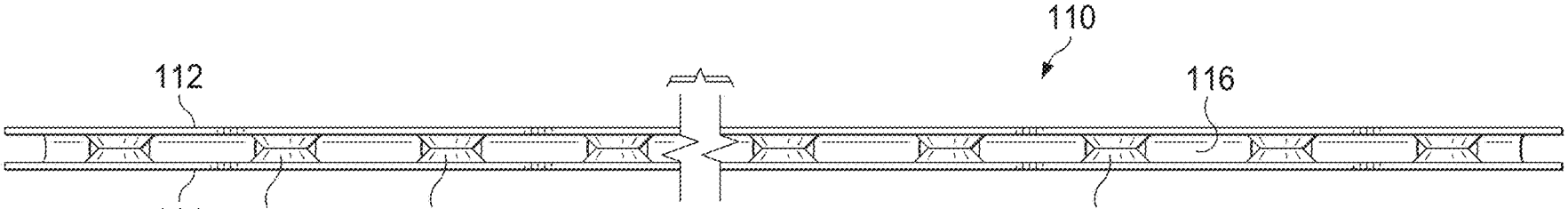
FIG. 4 is a rear elevation view of the cross bar of FIG. 2.
Figure 6:
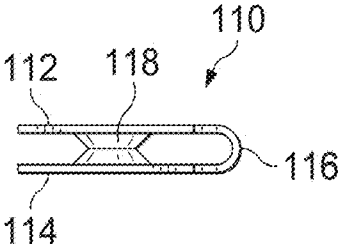
FIG. 6 is a left side view of the cross bar of FIG. 2.
Figure 5:
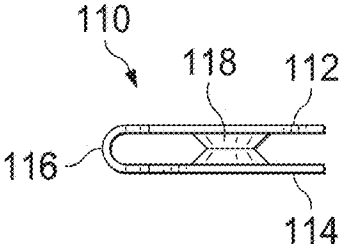
FIG. 5 is a right side view of the cross bar of FIG. 2.
Figure 7:
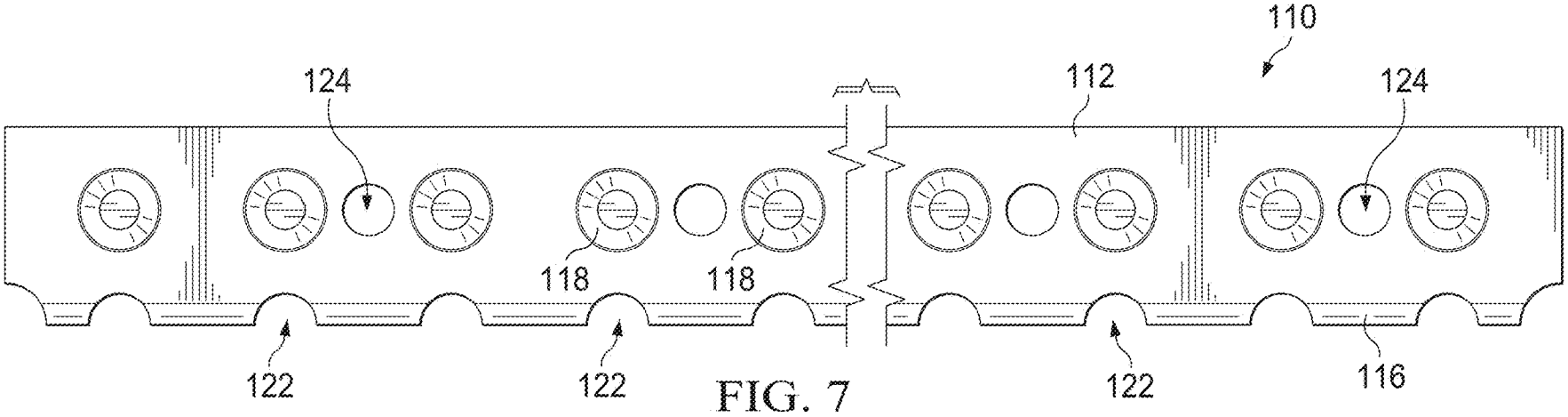
FIG. 7 is a top view of the cross bar of FIG. 2.
Figure 8:
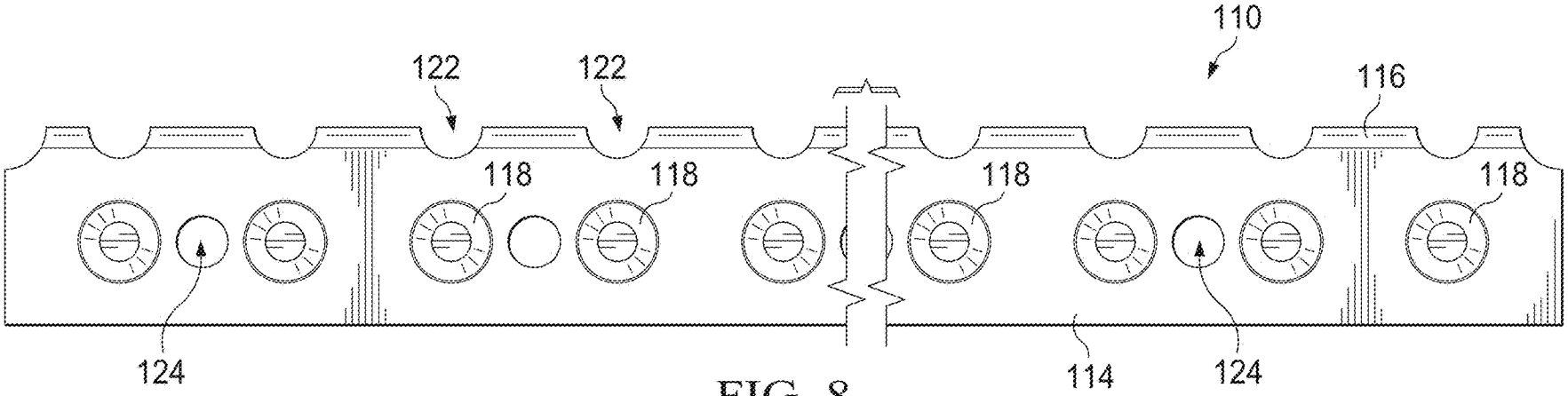
FIG. 8 is a bottom view of the cross bar of FIG. 2.
Figure 9:
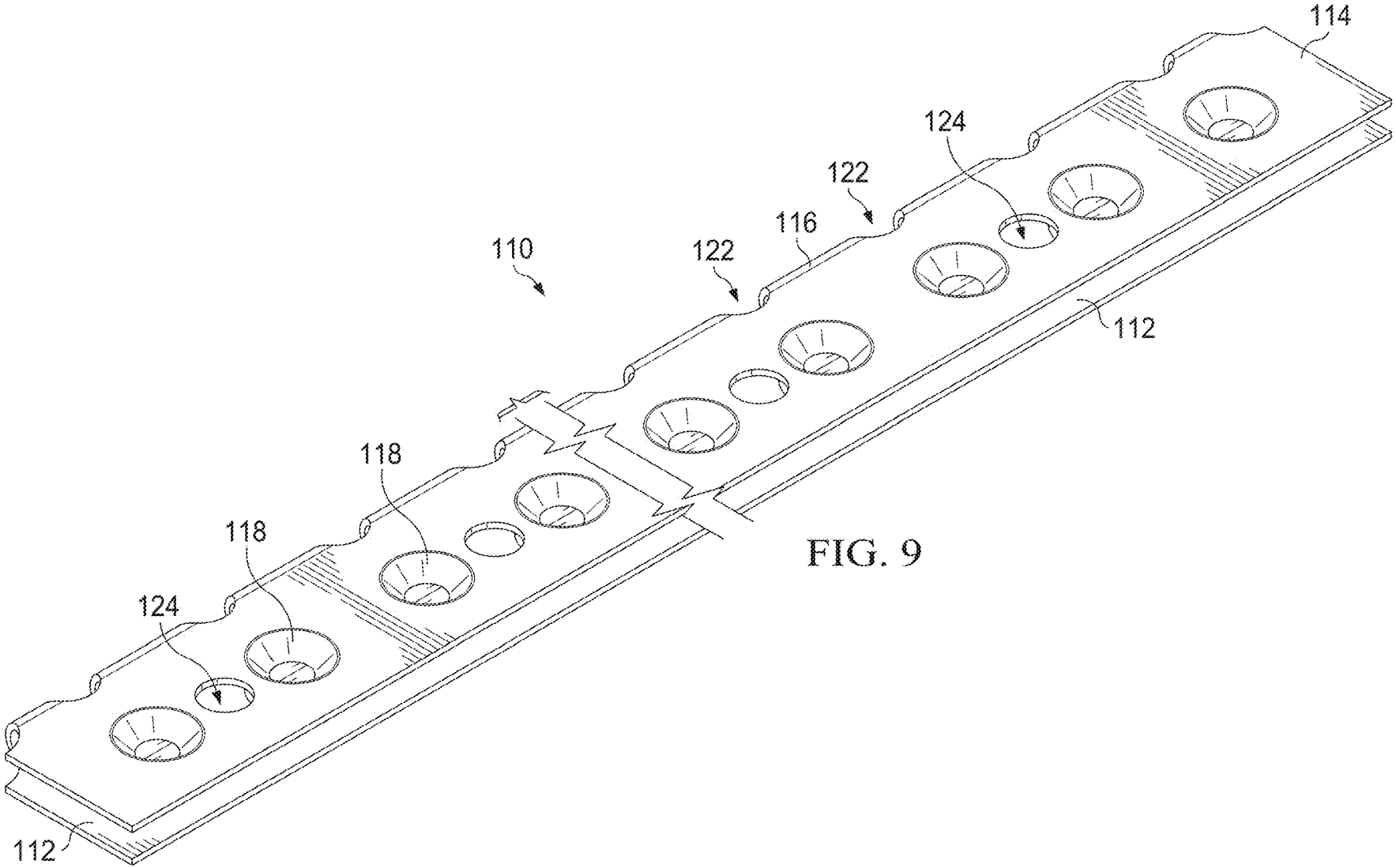
FIG. 9 is a rear perspective view of the cross bar of FIG. 2.

FIG. 2 though FIG. 9 illustrate another exemplary cross bar 110. A front portion 112 may comprise a series of embosses 118 spaced apart from one another along the length of the cross bar 110. A rear portion 114 may, alternatively or additionally, comprise a series of embosses 118 spaced apart from one another along the length of the cross bar 110. The embosses 118 provided on the front portion 112 may be aligned with the embosses 118 on the rear portion 114 such that the embosses 118 contact one another. In other exemplary embodiments, the embosses 118 on the front portion 112 may be staggered from the embosses on the rear portion 112. In yet other exemplary embodiments, the embosses 118 may provided on just one of the front portion 112 or the rear portion 114.

A connector 116 may extend between the front portion 112 and the rear portion 114. In exemplary embodiments, the connector 116 may extend between an upper edge of the front portion 112 and an upper edge of the rear portion 114. A first set of drain holes 122 may comprise a series of openings that are spaced apart along the connector 116. Each of the first set of drain holes 122 may be circular in shape, though other shapes are contemplated. In exemplary embodiments, each of the holes in the first set of drain holes 122 may be located substantially above each of the embosses 118.

A second set of drain holes 124 may be spaced apart along the front portion 112 and/or along the rear portion 114. The second set of drain holes 124 may be circular in shape. The second set of drain holes 124 may be spaced apart such that two embosses 118 are located between each of the holes in the second set of drain holes 124. The second set of drain holes 124 located along the front portion 112 may be staggered from the second set of drain holes 124 located along the rear portion 114 such that water entering the cross bar 110 through the first set of drain holes 122 may contact the opposite side 112 or 114 and be dispersed through the cross bar 110 to promote thorough rinsing, cleaning, or other coverage. The first set of drain holes 122 may be staggered relative to the second set of drain holes such that water entering the cross bar 110 may be forced to take a sinuous route through the cross bar 110 before exiting to promote thorough rinsing, cleaning, or other coverage.

In some exemplary embodiments, the cross bar 110 may be formed by punching, cutting, or otherwise forming various holes, including but not limited to, the first set of drain holes 122 and the second set of drain holes 124, into a piece of sheet metal, forming the embosses 118, and folding the sheet metal to form the front portion 112, the rear portion 114, and the connector 116. The embosses 118 may be welded to one another.

FIG. 10 illustrates a front view of another exemplary cross bar 210 with an exemplary hanger 220 installed between adjacent embosses 218. Installation may be accomplished by wedging the hanger 220 between the adjacent embosses 218 or otherwise frictionally engaging the hanger 220 with the embosses 218. The hanger 220 may be comprised of steel, though any material may be utilized. In exemplary embodiments, the hangers 220 are resiliently deformable such that they may be compressed between adjacent embosses 218, removed, and reused.

Exemplary embodiments comprise a method for coating a metal part by using a cross bar that is adapted for use in both the e-coating and powder coating processes. The method may be implemented the exemplary cross bars described herein, such as but not limited to, those shown and described with respect to FIGS. 1 through 10. For example, in such exemplary methods, the cross bar 10, 110, or 220 may be used for both e-coating and powder coating. However, such methods may be utilized with other cross bars. One or more hangers 220 may be installed between adjacent embosses 18, 118, or 218. Various parts to be powder coated or e-coated may be hung from the hangers 220. A number of the cross bars 10, 110, or 220 may be placed on one or more racks. An electrical change may be passed through the cross bar 10, 110, or 220, the associated hangers 220, and the associated parts. A coating may be deposited on the parts using a powder coating or e-coating process. The parts may be removed from the hangers 220.

If e-coating is performed, the excess liquid may be permitted to drain through one or more of the holes such as, but not limited to, the first set of holes 22, 122, or 222, the second set of holes 24, 124, or 224, and the third set of holes 26 or 126. The cross bar 10, 110, or 220 may be rinsed by spraying water into one or more of the holes such as, but not limited to, the first set of holes 22, 122, or 222, the second set of holes 24, 124, or 224, and the third set of holes 26 or 126. Alternatively, or in addition, the cross bars 10, 110, or 220 may be placed in an oven and exposed to high temperatures to remove excess coating deposited thereon. The hangers 220 may be removed from the cross bar 10, 110, or 220. The cross bars 10, 110, or 220 may be removed from the rack. The aforementioned steps may be performed in any order and may be repeated any number of times. Other coating techniques and coating materials may be utilized. Other cleaning techniques and fluids may be utilized.

Any embodiment of the present invention may include any of the optional or preferred features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention. It is the intention, therefore, to limit the invention only as indicated by the scope of the claims.

What is claimed is:

1. A cross bar for powder coating and electronic coating, said cross bar comprising:

a front portion;

a rear portion;

a connector extending between the front portion and the rear portion;

a first number of embosses in the front portion;

a second number of embosses in the rear portion, wherein each of the first number of embosses connect to a respective one of each of the second number of embosses;

a first number of drain holes spaced apart along the front portion; and a second number of drain holes spaced apart along the rear portion;

wherein each of the second number of drain holes are offset from each of the first number of drain holes.

2. The cross bar of claim 1 wherein:

the front portion, the rear portion, and the connector are integrally formed.

3. The cross bar of claim 1 wherein:

each of the first number of drain holes are provided between adjacent ones of the first number of embosses; and each of the second number of drain holes are provided between adjacent ones of the second number of embosses.

4. The cross bar of claim 3 wherein:

each of the first number of drain holes are provided between every two adjacent ones of the first number of embosses; and each of the second number of drain holes are provided between every two adjacent ones of the second number of embosses.

5. The cross bar of claim 4 wherein:

each of the first number of drain holes are circular in shape; and each of the second number of drain holes are circular in shape.

6. The cross bar of claim 4 wherein:

each of the first number of drain holes are oval in shape; and each of the second number of drain holes are oval in shape.

7. The cross bar of claim 1 further comprising:

a number of lower drain notches spaced apart along a lower edge of at least one of: the front portion and the rear portion.

8. The cross bar of claim 1 wherein:

the first and second number of embosses are configured to accommodate a hanger between adjacent ones of the first and second number of embosses.

9. The cross bar of claim 1 wherein:

each of said first and second number of embosses are shaped as truncated cones.

10. The cross bar of claim 1 further comprising:

a number of lower drain notches spaced apart along a lower edge of at least one of: the front portion and the rear portion.

11. The cross bar of claim 1 further comprising:

a number of upper drain holes spaced apart along the connector.

12. A cross bar for powder coating and electronic coating, said cross bar comprising:

a horizontal member comprised of an electrically conductive material and configured to accommodate a number of hangers for parts to be powder coated or electronic coated, said horizontal member comprising:

a front portion; and a second portion spaced apart from the front portion;

a connector extending between the front portion and the second portion; and a number of drain holes formed in the horizontal member and configured to drain liquid used to clean the cross bar after powder coating or electronic coating, said number of drain holes comprising:

a first number of drain holes formed in the front portion; and a second number of drain holes formed in the rear portion, wherein each of the first number of drain holes are offset from each of the second number of drain holes.

13. The cross bar of claim 12 wherein:

said front portion extends parallel with said rear portion; and said connector extends between an upper edge of said front portion and an upper edge of said rear portion.

14. The cross bar of claim 13 wherein:

said first number of drain holes are provided in a line along the front portion; and said second number of drain holes are provided in a line along the front portion.

15. The cross bar of claim 14 further comprising:

a number of embosses extending between said front portion and said rear portion, wherein at least a front portion of said number of drain holes are positioned between adjacent ones of said number of embosses.

16. The cross bar of claim 15 further comprising:

a number of drain notches provided at spaced intervals along a lower edge of at least one of the front portion and the rear portion.

17. The cross bar of claim 16 wherein:

said front portion has the same surface area as the rear portion.

18. A method for forming a cross bar for powder coating and electronic coating, said method comprising the steps of:

providing a section of sheet metal;

forming a number of drain holes in said section sheet metal;

folding said section of sheet metal in half to form a front portion, a rear portion, and a connector such that the front portion is spaced apart from the rear portion and the connector extends between an upper edge of the front portion and an upper edge of the rear portion;

forming a first number of embosses in the front portion;

forming a second number of embosses in the rear portion, wherein each of said first number of embosses are aligned with a corresponding one of the second number of embosses; and joining each of said first number of embosses with the corresponding one of the second number of embosses;

wherein said number of drain holes comprise a first number of drain holes positioned to be located in the front portion when the section of sheet metal is folded and a second number of drain holes positioned to be located in the rear portion when the section of sheet metal is folded wherein each of the first number of drain holes are positioned to be offset from each of the second number of drain holes when the second sheet metal is folded.

19. The method of claim 18 wherein:

said drain holes are formed by punching;

said section of sheet metal is rectangular in shape; and said first and second number of embosses are joined to one another by welding.

* * * * *